US006033266A

United States Patent [19]

Long

[11] Patent Number: 6,033,266

[45] Date of Patent: Mar. 7, 2000

[54] MODULAR CONNECTOR WITH PRELOAD AND BEAM LENGTH REDUCTION FEATURES

[75] Inventor: Michael D. Long, Harrisburg, Pa.

[73] Assignee: The Whitaker Corporation, Wilmington, Del.

[21] Appl. No.: 09/143,799

[22] Filed: Aug. 31, 1998

[51] Int. Cl.[7] ..... H01R 23/02

[52] U.S. Cl. ..... 439/676

[58] Field of Search ..... 439/676, 862, 439/660, 637, 636

[56] References Cited

U.S. PATENT DOCUMENTS

| | | | |
|---|---|---|---|
| 4,457,570 | 7/1984 | Bogese, II et al. | 339/17 C |
| 5,145,401 | 9/1992 | Archer | 439/676 |
| 5,178,563 | 1/1993 | Reed | 439/676 |
| 5,362,257 | 11/1994 | Neal et al. | 439/676 |
| 5,531,612 | 7/1996 | Goodall et al. | 439/541.5 |
| 5,702,271 | 12/1997 | Steinman | 439/676 |

*Primary Examiner*—Khiem Nguyen
*Assistant Examiner*—Javaid Nasri
*Attorney, Agent, or Firm*—Robert Kapalka

[57] ABSTRACT

A connector includes a contact insert, at least one contact, and a housing. The contact is mounted to the contact insert. The contact includes a mounting portion coupled to the contact insert and a beam portion having a length. The housing is engageable with the contact insert. The housing includes a first portion adapted to deflect the beam portion and a second portion adapted to contact the beam portion at a pivot point along the length of the beam portion.

18 Claims, 6 Drawing Sheets

MODULAR CONNECTOR WITH PRELOAD AND BEAM LENGTH REDUCTION FEATURES

BACKGROUND OF THE INVENTION

1. Field of the Invention

This invention relates generally to electrical connectors, such as modular jack connectors, and more particularly, to a connector with preload and beam length reduction features.

2. Description of the Related Art

Modular plugs are widely used to provide electrical connections between devices. For example, modular plugs are typically found on telephone sets to connect the telephone to a modular jack. Modular plug and jack connectors are also commonly used to connect computer equipment. A modular jack connector typically has electrical contacts that have a spring characteristic. The spring-like nature of the contacts that keeps them in electrical contact with the modular plug when it is inserted into the modular jack.

The quality of the electrical connection between the contacts in the modular jack and the interfacing plug depends to a great extent on the normal forces exerted by the spring-like modular jack contact on the plug. Typically, the spring-like contacts are cantilevered beams, where the generated normal force depends on, among other things, the amount of deflection and the beam length of the contact. Increasing the length of the contacts increases the beam length and negatively affects the amount of normal force generated between the contact and the plug interfaced with the modular jack.

To simplify the manufacturing process for modular jacks, certain separate parts are independently produced and later assembled to form the modular jack. It is common to form (e.g., by molding) a modular jack housing and a contact insert separately. The contact insert includes the contacts, which are typically molded or stitched (i.e., interference fit) into the contact insert. The majority of the length of the contacts extends from the molded body of the contact insert. When modular jacks of this type are used, care must be taken when the contact insert is positioned into the housing to prevent misalignment or buckling of the contacts.

The present invention is directed to overcoming, or at least reducing the effects of, one or more of the problems set forth above.

SUMMARY OF THE INVENTION

One aspect of the present invention is seen in a connector having a contact insert, at least one contact, and a housing. The contact is mounted to the contact insert. The contact includes a mounting portion coupled to the contact insert and a beam portion having a length. The housing is engageable with the contact insert. The housing includes a first portion adapted to deflect the beam portion and a second portion adapted to contact the beam portion at a pivot point along the length of the beam portion.

BRIEF DESCRIPTION OF THE DRAWINGS

The invention may be best understood by reference to the following description taken in conjunction with the accompanying drawings, in which like reference numerals identify like elements, and in which:

FIG. 3 is a cross-sectional view showing components of the modular jack assembly in a first stage of engagement;

Figure 1:
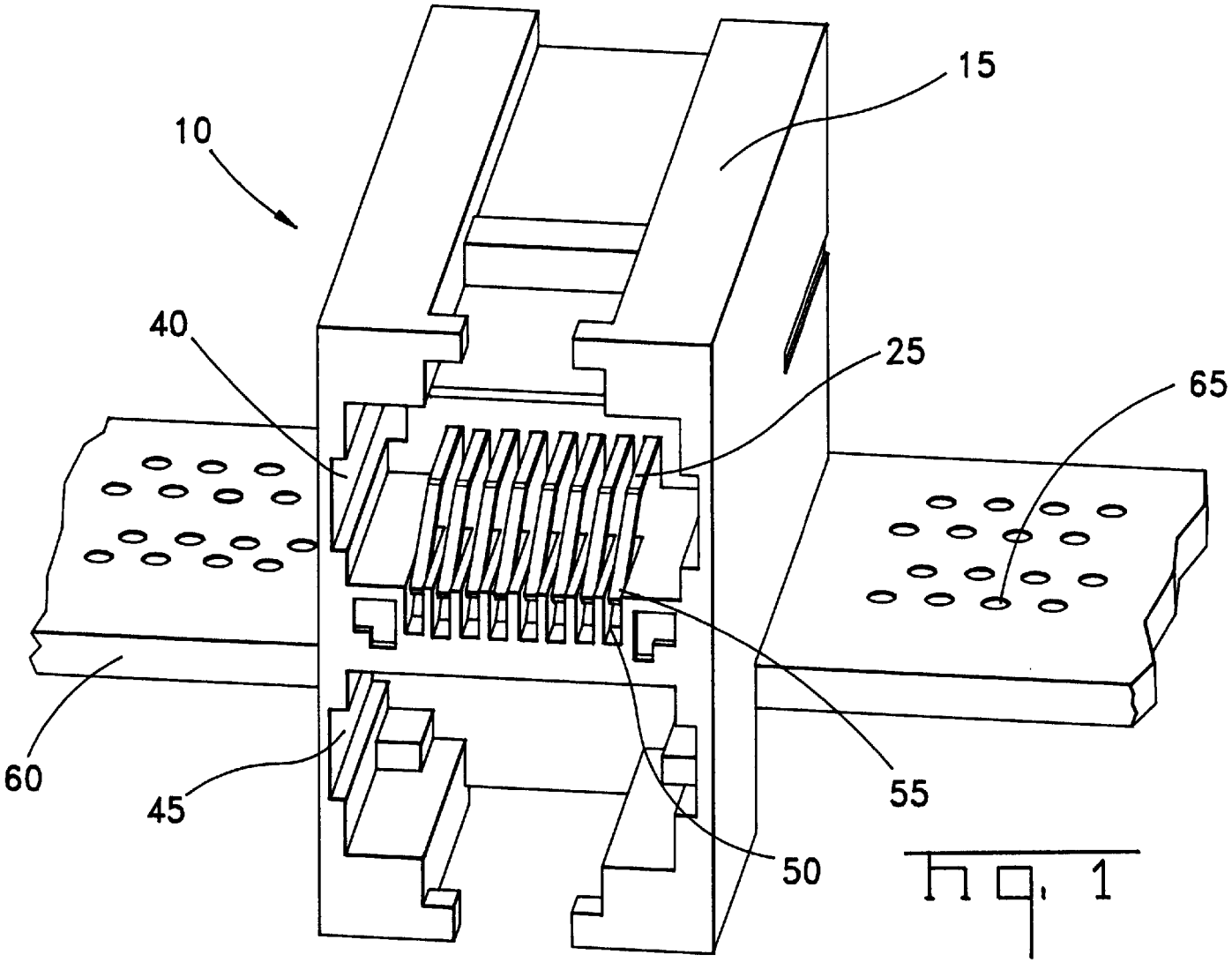
FIG. 1 is an isometric front view of a modular jack assembly in accordance with the present invention.

While the invention is susceptible to various modifications and alternative forms, specific embodiments thereof have been shown by way of example in the drawings and are herein described in detail. It should be understood, however, that the description herein of specific embodiments is not intended to limit the invention to the particular forms disclosed, but on the contrary, the intention is to cover all modifications, equivalents, and alternatives falling within the spirit and scope of the invention as defined by the appended claims.

DETAILED DESCRIPTION OF SPECIFIC EMBODIMENTS

Illustrative embodiments of the invention are described below. In the interest of clarity, not all features of an actual implementation are described in this specification. It will of course be appreciated that in the development of any such actual embodiment, numerous implementation-specific decisions must be made to achieve the developers' specific goals, such as compliance with system-related and business-related constraints, which will vary from one implementation to another. Moreover, it will be appreciated that such a development effort might be complex and time-consuming, but would nevertheless be a routine undertaking for those of ordinary skill in the art having the benefit of this disclosure.

Figure 2:
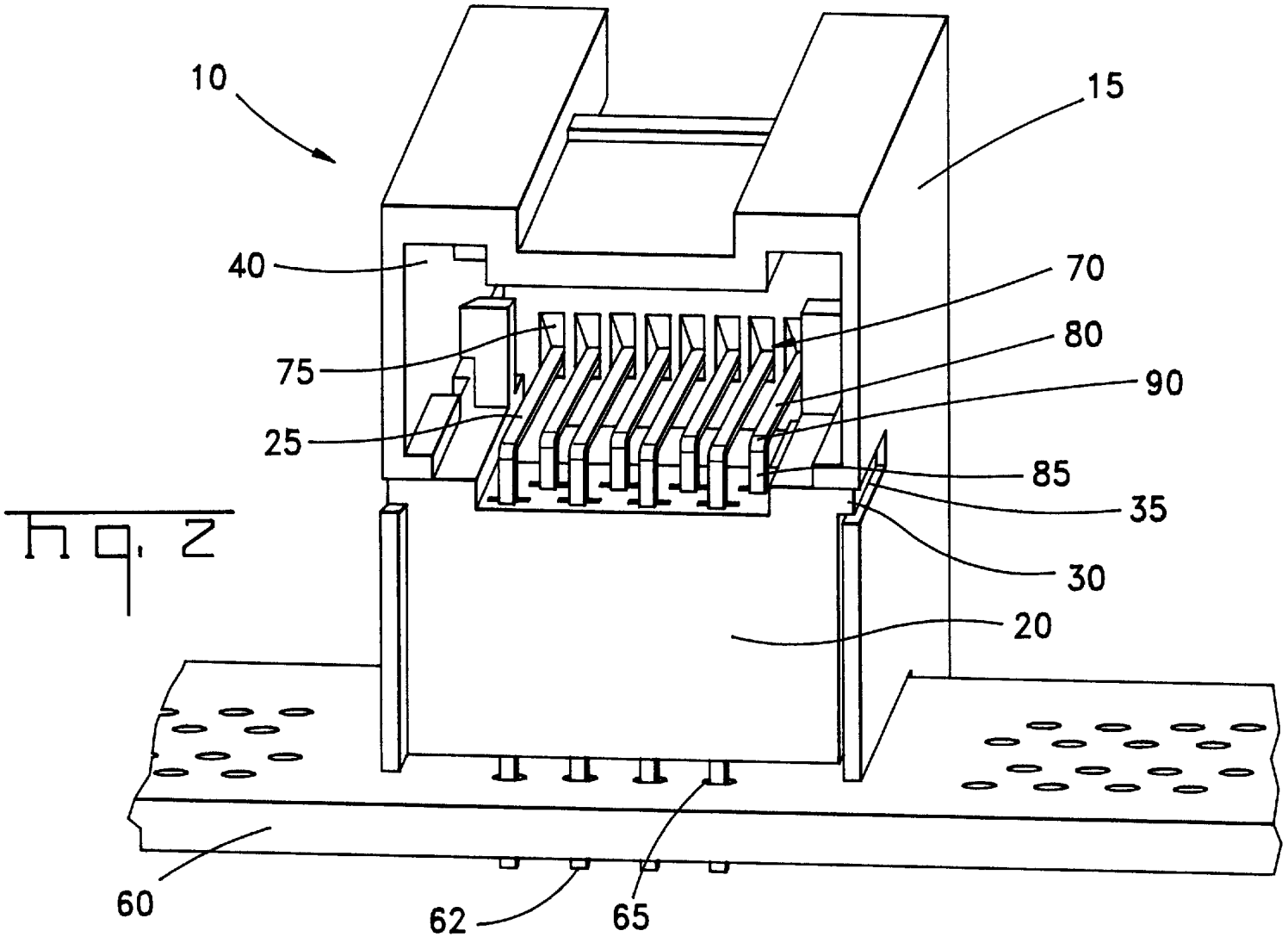
FIG. 2 is an isometric rear view of the modular jack assembly of FIG. 1.
Figure 7:
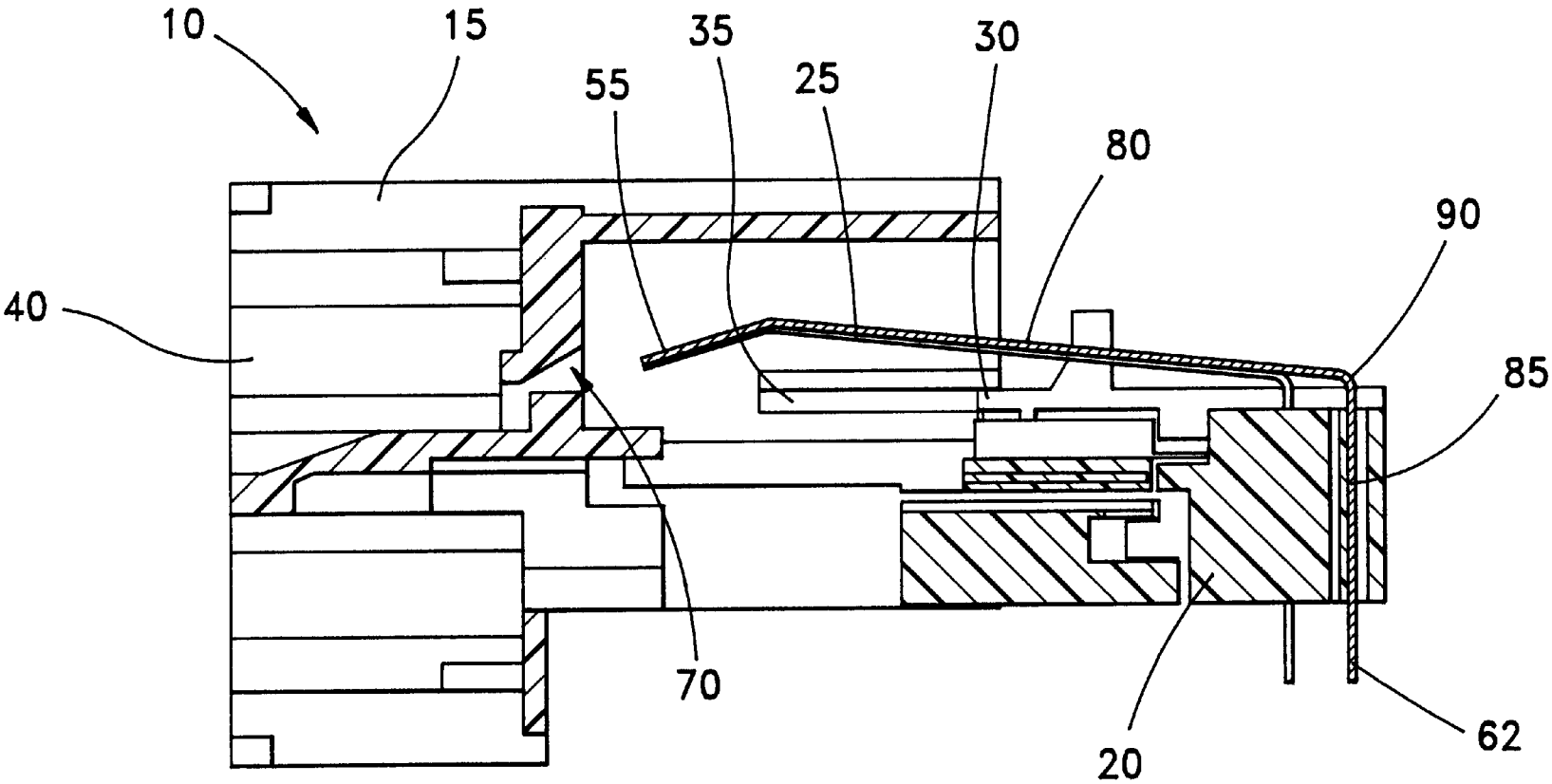

Referring to the Figures, and in particular, to FIGS. 1 and 2, isometric front and rear views of a modular jack assembly 10 are provided. The modular jack assembly 10 includes a housing 15 and a contact insert 20. Typically, the housing 15 and contact insert 20 are formed separately, and the contact insert 20 is engaged with the housing 15 during the assembly of the modular jack assembly 10. The contact insert 20 includes a plurality of contacts 25 that may be molded or stitched (i.e., interference fit) into the contact insert 20. A tab 30 on the contact insert 20 interfaces with a notch 35 to align the contact insert 20 with respect to the housing 15. In the illustrated embodiment, the modular jack assembly 10 is adapted to receive interfacing plugs (not shown) in a top plug receptacle 40 and a bottom plug receptacle 45. For clarity and ease of illustration, only the contacts 25 on the contact insert 20 associated with the top plug receptacle 40 are described hereinafter.

FIGS. 1 and 2 illustrate the contact insert 20 fully engaged with the housing 15. Alignment channels 50 defined in the housing 15 receive the distal ends 55 of the contacts 25 as the contact insert 20 is being inserted into the housing 15. The alignment channels 50 serve to maintain the spacing between adjacent contacts 25 to help ensure that the interfacing plug (not shown) mates properly with the modular jack assembly 10 when inserted therein.

The modular jack assembly 10 is mounted to a circuit board 60. The proximal ends 62 of the contacts 25 protrude from the contact insert 20 and interface with corresponding contact holes 65 defined in the circuit board 60. In the illustrated embodiment, one or more modular jack assemblies 10 may be mounted in rows on the circuit board 60. Contact windows 70 are defined in the housing 15 for receiving the contacts 25 as the contact insert 20 is being inserted into the housing 15. The contact windows 70 cooperate with the alignment channels 50 to positively align the contacts 25 within the completed modular jack assembly 10.

The contact windows 70 each include an angled wall 75 that tends to deflect the contacts 25 in a downward direction as the contact insert 20 is being engaged with the housing 15 and the contacts 25 are being inserted through the contact windows 70. The contacts 25 are cantilevered beams that act as springs when engaged with and deflected downwardly by the interfacing plug (not shown) inserted into the top plug receptacle 40 (shown in FIG. 2). The spring action provides a normal force between the contacts 25 and the interfacing plug (not shown) to establish and maintain a reliable electrical connection therebetween. Deflecting the contacts 25 downwardly effectively preloads the contacts 25, and thus increases the normal forces between the contacts 25 and the interfacing plug (not shown) when the interfacing plug is engaged with the modular jack assembly 10.

Figure 4:
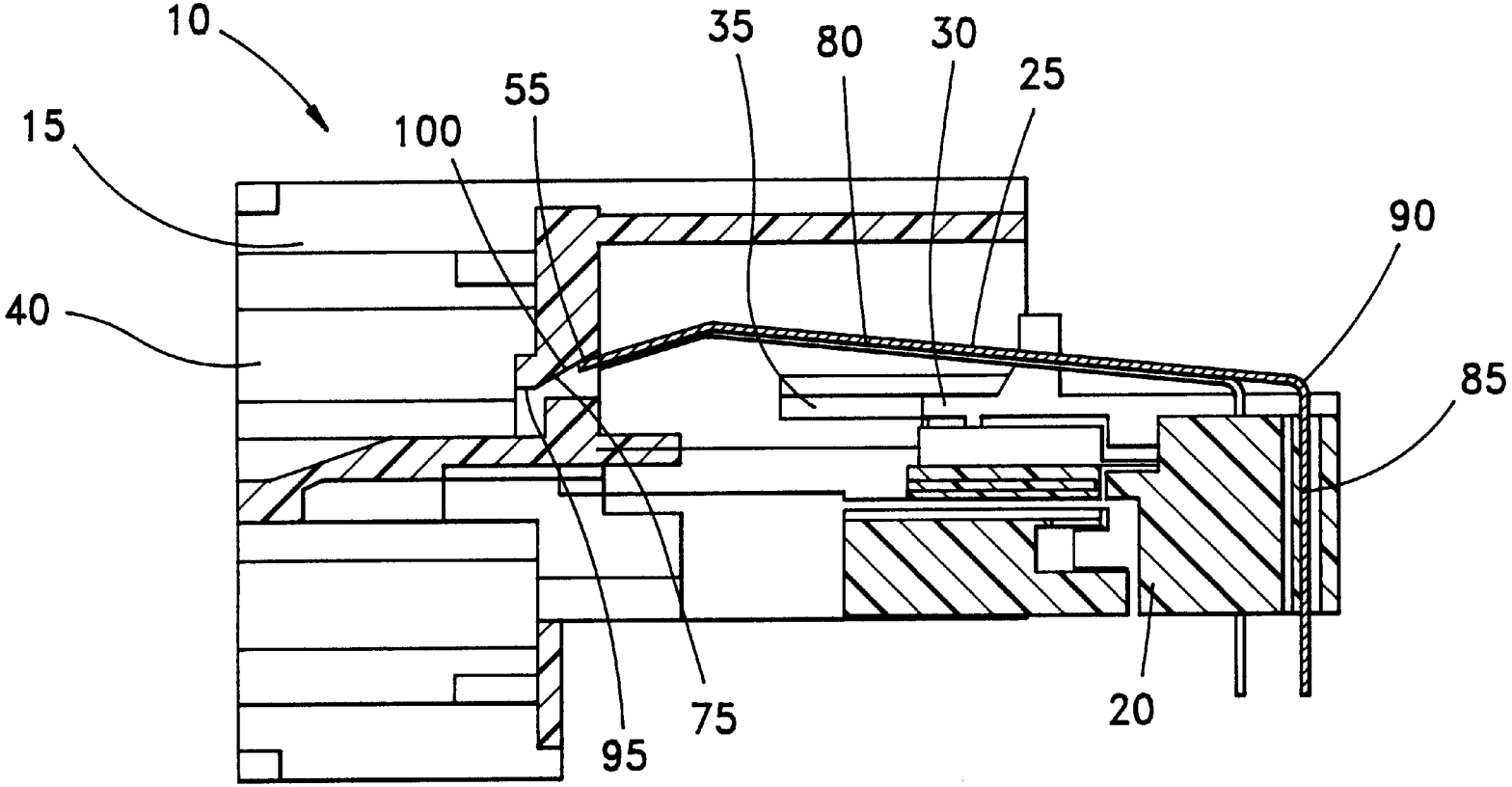
FIG. 4 is a cross-sectional view showing the components in a second stage of engagement.
Figure 5:
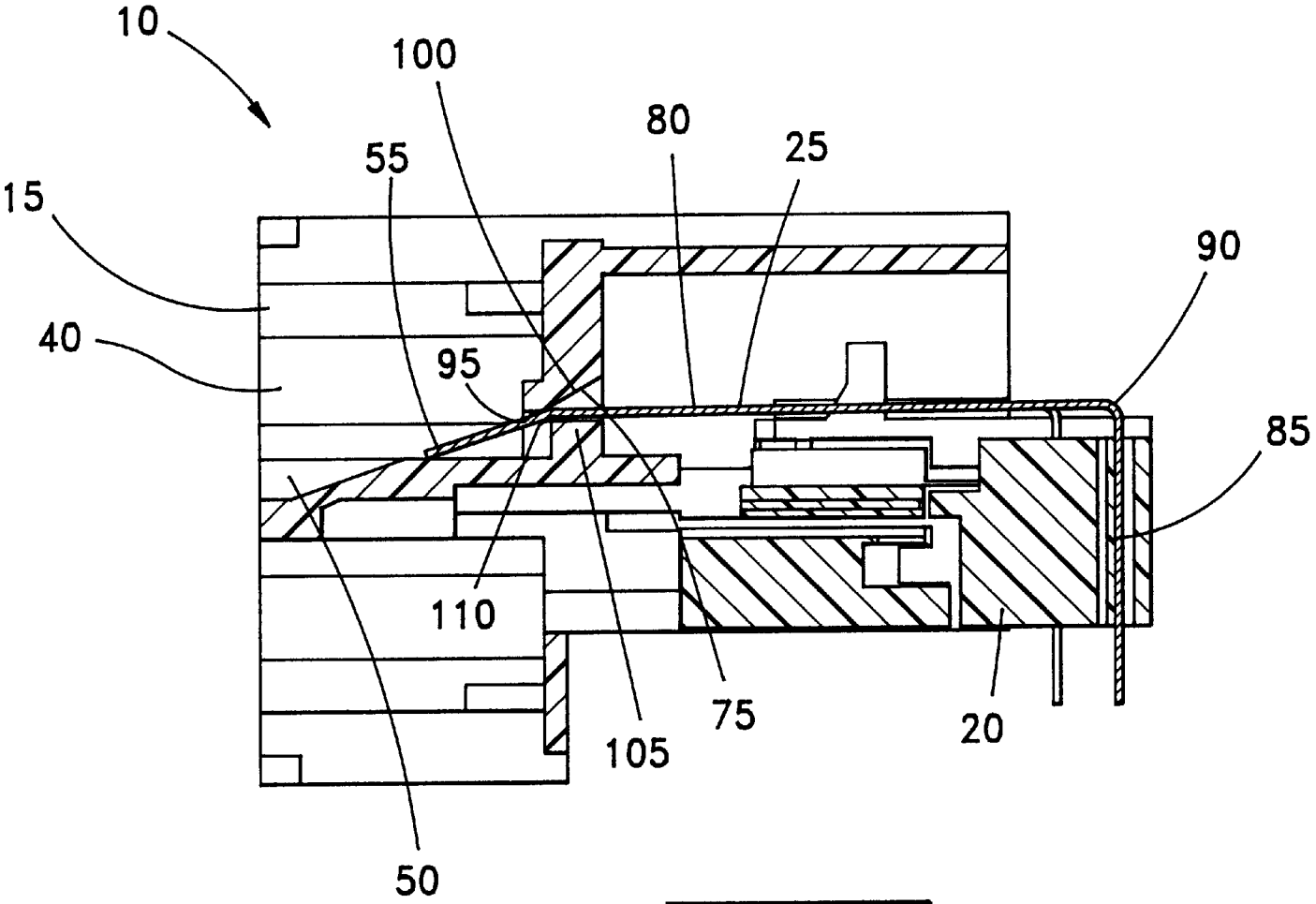
FIG. 5 is a cross-sectional view showing the components in a third stage of engagement.
Figure 6:
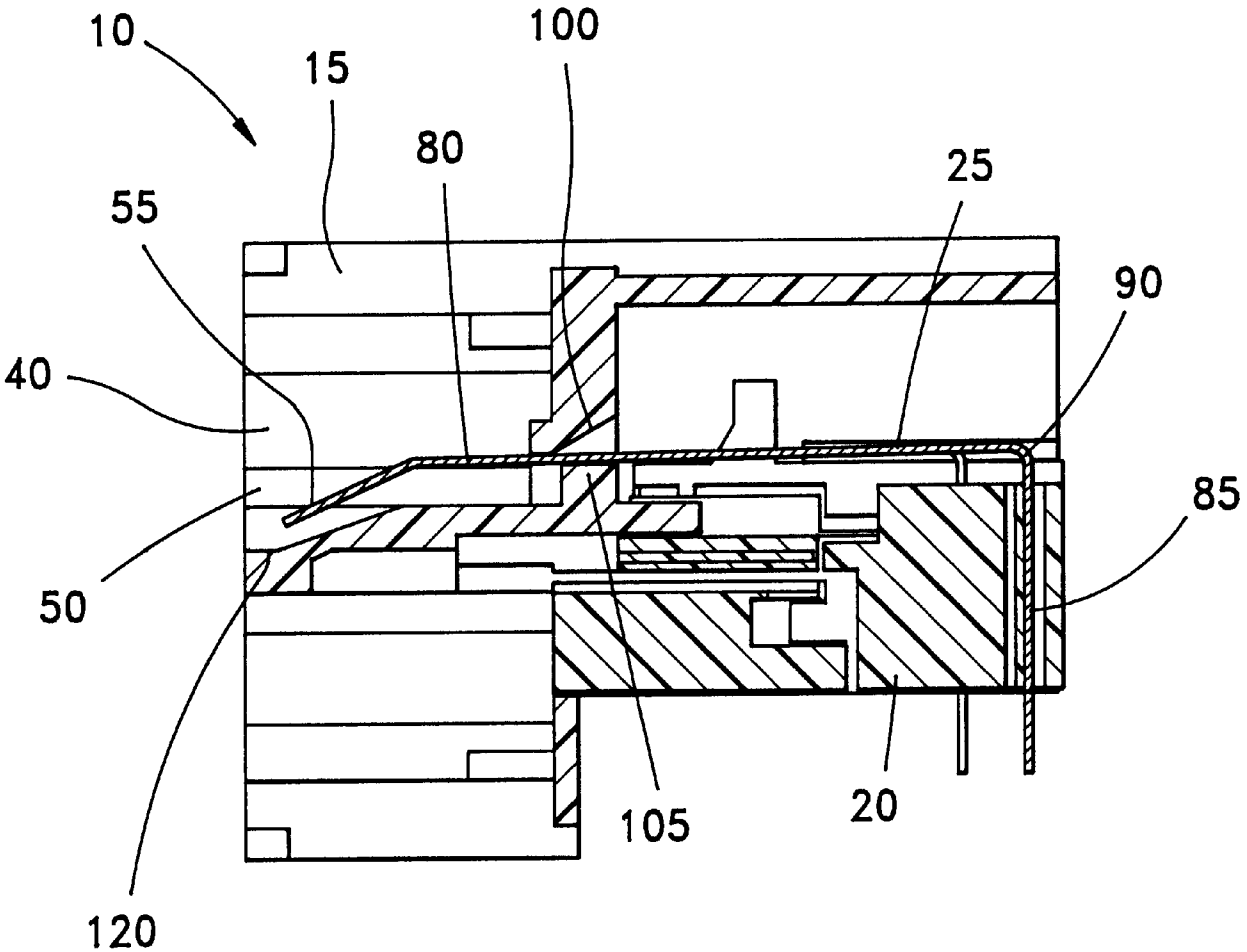
FIG. 6 is a cross-sectional view showing the components in a final stage of engagement.

Referring to FIGS. 3–6, cross-sections of the modular jack assembly 10 are shown with the contact insert 20 in various stages of engagement with the housing 15. FIG. 3 illustrates the contact insert 20 in its initial stage of engagement with the housing 15, and FIG. 6 illustrates the contact insert 20 in its final stage of engagement with the housing 15. Again, only the contacts 25 for the top plug receptacle 40 are illustrated. As seen in FIG. 3, the tab 30, defined in the contact insert 20, is engaging the cooperating notch 35 defined in the housing 15. In this position, the distal end 55 of the contact 25 has not yet engaged the contact window 70 defined in the housing 15.

The contact 25 includes a beam portion 80 and a mounting portion 85. The beam portion 80 includes the distal end 55 of the contact 25, and the mounting portion includes the proximal end 62 of the contact 25. In the illustrated embodiment, the distal end 55 is angled with respect to the beam portion 80, although this is not required. The beam portion 80 acts as a cantilevered beam to provide the normal force necessary to establish an electrical connection with the contacts in an interfacing plug (not shown). As with any cantilevered structure, the force provided depends on, among other things, the amount of deflection, the effective beam length of the structure, the material of construction of the structure, and the cross-sectional area of the beam. The mounting portion 85 is engaged with the contact insert 20 (e.g., by molding or stitching) to support the contact 25 within the insert 20. The pivot point for the beam portion 80 that defines its effective beam length is the corner 90 between the beam portion 80 and the mounting portion 85 (i.e., in the unengaged insert 20).

FIG. 4 illustrates the distal end 55 of the contact 25 as it first engages the contact window 70. The distal end 55 contacts the angled wall 75 of the contact window 70. As seen in FIG. 5, as the contact insert 20 is further engaged with the housing 15, the angled wall 75 further deflects the contact 25 in a downward direction, thus preloading the contact 25. As the contact passes through the contact window 70, the contact ceases to engage the angled wall 75 and engages a foot portion 95 defined in the contact window 70 proximate the angled wall 75. Collectively, the angled wall 75 and the foot portion 95 define a preload structure 100.

As seen in FIGS. 5 and 6, the housing 15 also includes a fulcrum structure 105 defined by the bottom surface of the contact window 70. As the contact 25 is deflected downwardly it ultimately contacts the fulcrum structure 105. The front edge 110 of the fulcrum structure 105 thus becomes a new pivot point for the beam portion 80, thus redefining its effective beam length. All other things being equal, shortening the beam length increases the normal force generated by a given amount of deflection. By reducing the beam length of the contact 25, the fulcrum structure 105 increases the normal force between the contacts 25 and the interfacing plug (not shown).

FIG. 5 also illustrates the distal end 55 of the contact 25 interfacing with the alignment channel 50 defined in the contact insert 20. As stated above, the alignment channel 50 helps maintain the horizontal alignment between adjacent contacts 25 during engagement of the contact insert 20 and also during the repeated mating between the modular jack assembly 10 and the interfacing plug (not shown) experienced during usage of the modular jack assembly 10.

FIG. 6 illustrates the contact insert 20 in full engagement with the housing 15. In the fully engaged position, the contact 25 contacts the preload structure 100. A small gap exists between the contact 25 and the fulcrum structure 105 to allow for insertion of the contact 25 during the assembly of the modular jack assembly 10. When the interfacing plug (not shown) is engaged with the modular jack assembly 10, the contact 25 engages the fulcrum structure 105. The preload structure 100 and the fulcrum structure 105 both function to increase the normal force between the contact 25 and the interfacing plug (not shown).

As seen in FIG. 6, the distal end 55 of the contact 25 is located within the alignment channel 50. The contact 25 does not contact the floor 120 of the alignment channel 50 so that the contact 25 may be deflected downwardly when the interfacing plug (not shown) in engaged with the modular jack assembly 10. Due to manufacturing tolerances, it is possible that the contact 25 may contact the floor 120 of the alignment channel 50. This additional contact creates an additional pivot point, which functions to further increase the normal forces between the contact 25 and the interfacing plug (not shown).

The particular embodiments disclosed above are illustrative only, as the invention may be modified and practiced in different but equivalent manners apparent to those skilled in the art having the benefit of the teachings herein. Furthermore, no limitations are intended to the details of construction or design herein shown, other than as described in the claims below. It is therefore evident that the particular embodiments disclosed above may be altered or modified and all such variations are considered within the scope and spirit of the invention. Accordingly, the protection sought herein is as set forth in the claims below.

What is claimed:

1. A connector comprising:

a contact insert;

at least one contact mounted to the contact insert, the contact comprising a mounting portion coupled to the contact insert and a beam portion which is cantilevered from a pivot point, the beam portion having an effective length extending from the pivot point to a distal end;

a housing engageable with the contact insert, wherein the housing comprises:

a first portion adapted to deflect the beam portion; and a second portion adapted to contact the beam portion between the pivot point and the distal end, thereby establishing a new pivot point for the beam portion, the new pivot point being disposed so as to oppose a deflection imposed on the beam portion during engagement with a mating connector, wherein the effective length of the beam portion is reduced.

2. The connector of claim 1, wherein the housing further comprises:

a contact window adapted to receive at least a portion of the beam portion of the contact.

3. The connector of claim 2, wherein the first portion comprises an angled wall.

4. The connector of claim 3, wherein the angled wall is defined in the contact window.

5. The connector of claim 4, wherein the first portion further comprises a foot portion defined in the contact window proximate the angled wall.

6. The connector of claim 2, wherein the second portion comprises a bottom surface of the contact window.

7. The connector of claim 1, wherein the second portion includes an edge which serves as the new pivot point.

8. The connector of claim 1, further comprising an alignment channel defined in the housing, wherein at least a portion of the contact is contained in the alignment channel.

9. The connector of claim 8, wherein the alignment channel includes a floor, and the contact engages the floor.

10. The connector of claim 1, wherein the contact insert engages with the housing to form a modular jack assembly.

11. The connector of claim 1, further comprising:

a tab defined in the contact insert; and a notch defined in the housing, wherein the tab cooperates with the notch to align the contact insert with the housing.

12. A connector comprising:

a contact insert;

at least one contact mounted to the contact insert, the contact comprising a mounting portion coupled to the contact insert and a beam portion which is cantilevered from a pivot point, the beam portion having an effective length extending from the pivot point to a distal end;

a housing engageable with the contact insert, wherein the housing comprises:

a preload structure adapted to deflect the beam portion; and a fulcrum structure adapted to contact the beam portion between the pivot point and the distal end, thereby establishing a new pivot point for the beam portion, the new pivot point being disposed so as to oppose a deflection imposed on the beam portion during engagement with a mating connector, wherein the effective length of the beam portion is reduced.

13. The connector of claim 12, further comprising:

a contact window defined in the housing and being adapted to receive at least a portion of the beam portion of the contact.

14. The connector of claim 13, wherein the preload structure comprises an angled wall defined in the contact window.

15. The connector of claim 14, wherein the preload structure includes a foot portion defined in the contact window proximate the angled wall.

16. The connector of claim 12, further comprising an alignment channel defined in the housing, wherein at least a portion of the contact is contained in the alignment channel.

17. The connector of claim 16, wherein the alignment channel includes a floor, and the contact engages the floor.

18. A connector comprising:

a contact insert including an electrical contact having a beam portion which is cantilevered from a pivot point and which has an effective length extending from the pivot point to a distal end; and a housing engageable with the contact insert, the housing including a fulcrum structure adapted to contact the beam portion between the pivot point and the distal end, thereby establishing a new pivot point for the beam portion, the new pivot point being disposed so as to oppose a deflection imposed on the beam portion during engagement with a mating connector, wherein the effective length of the beam portion is reduced.

* * * * *